US006314596B1

(12) United States Patent
Neff

(10) Patent No.: US 6,314,596 B1
(45) **Date of Patent: *Nov. 13, 2001**

(54) REACTIVE FLOOR TILING SYSTEM TO PROTECT AGAINST FALLS

(76) Inventor: Samuel R. Neff, 600 Fairview Rd., Narberth, PA (US) 19072

( * ) Notice: Subject to any disclaimer, the term of this patent is extended or adjusted under 35 U.S.C. 154(b) by 0 days.

This patent is subject to a terminal disclaimer.

(21) Appl. No.: 09/714,425

(22) Filed: Nov. 16, 2000

Related U.S. Application Data

(63) Continuation of application No. 09/363,539, filed on Jul. 29, 1999.

(51) Int. Cl.[7] ..... A47C 21/08
(52) U.S. Cl. ..... 5/420; 5/424
(58) Field of Search ..... 5/420, 417, 424, 5/710, 713; 182/137; 482/15

(56) References Cited

U.S. PATENT DOCUMENTS 5,052,065 10/1991 West .
5,057,819 10/1991 Valenti .
5,150,767 9/1992 Miller .
5,592,705 1/1997 West .
5,894,616 4/1999 Graham et al. .

*Primary Examiner*—Lynne H. Browne
*Assistant Examiner*—Fredrick Conley
(74) *Attorney, Agent, or Firm*—Caesar, Rivise, Bernstein, Cohen & Pokotilow, Ltd.

(57) ABSTRACT

A system for inexpensively placing an active fall-protection system in a floor is described. The floor is tessellated with large octagonal tiles and smaller square tiles. Each large octagonal tile contains a sodium azide-loaded airbag that expands, upon detonation, to 18 cm tall. Each square tile contains an infrared proximity detector and a differentiation. Upon accelerating approach of a large enough infrared-emitting object (such as a falling human body) the square tile detonates the four adjacent octagonal tiles. In this manner, the airbag tiles are deployed over the area of the floor destined to be impacted. Since the detectors respond to accelerating, large infrared-emitting objects, the floor tiles will not deploy during normal activities.

7 Claims, 4 Drawing Sheets

REACTIVE FLOOR TILING SYSTEM TO PROTECT AGAINST FALLS

This is a continuation of Ser. No. 09/363,539, filed on Jul. 29, 1999.

BACKGROUND OF THE INVENTION

This invention relates generally to medical devices and more particularly to systems for preventing injury of patients in hospitals and nursing homes.

Patient falls are a major public health problem. Each year, injuries due to falls in hospitals and nursing homes cost hundreds of millions of dollars. For a woman over 80 years of age who falls in the hospital and breaks her hip, the chances of returning to independent living are less than 50% and the mortality is 20%.

Examples of deployable impact systems are shown in the following U.S. patents:

U.S. Pat. No. 5,057,819 (Valenti) discloses a safety cushion that is positioned on the floor adjacent one side of a baby crib for cushioning the fall of a child. The cushion also includes an alarm for alerting an adult of the child's fall.

U.S. Pat. No. 5,150,767 (Miller) discloses a portable self-contained impact device that automatically inflates when a person (e.g., someone trying to escape a fire from an elevated position) impacts the device and can be reset for another evacuee.

U.S. Pat. No. 5,592,705 (West) discloses an impact cushioning device for bed occupants. The device comprises an air cushion that is stowed under the bed and is adapted to be immediately positioned under the falling occupant when the weight of the occupant is removed from the bed.

Thus, there remains a need for an automatic, rapidly-deploying impact prevention system that emanates from the flooring.

OBJECTS OF THE INVENTION

Accordingly, it is the object of this invention to provide a system for protecting people from injury from falls in hospitals.

It is further the object of this invention to provide a system that protect children from falls out of cribs or high beds (i.e. "bunk beds").

It is further the object of this invention to provide a system that is cost-effective.

SUMMARY OF THE INVENTION

These and other objects of the instant invention are achieved by providing an apparatus for use as a floor to automatically prevent an individual from falling against the floor. The apparatus comprises a detonator device having an inflatable means stored therein and wherein the detonator device has a top surface that acts as part of the floor when the inflatable means is in a stowed condition in the detonator device. The apparatus further comprises a detector device that is in electrical communication with the detonator device and is immediately adjacent the detonator device. The detector device has a top surface that acts as part of the floor. The detector device comprises a detector for detecting an individual falling towards the detector and activates the inflatable means to drive the top surface of the detonator device towards the falling individual.

These and other objects of the instant invention are also provided by a method for automatically preventing an individual from falling against a floor. The method comprises the steps of: providing a detonator device, positioned in the floor, with an inflatable means as part of the floor and stored within the detonator device; monitoring the immediate vicinity above the detonator device to determine if an individual is falling towards the detonator device; and activating the inflatable means whenever the individual is falling towards the detonator device to prevent the individual from striking the floor.

DESCRIPTION OF THE DRAWINGS

Other objects and many of the attendant advantages of this invention will be readily appreciated as the same becomes better understood by reference to the following detailed description when considered in connection with the accompanying drawings wherein.

DETAILED DESCRIPTION OF THE PREFERRED EMBODIMENT

Figure 1:
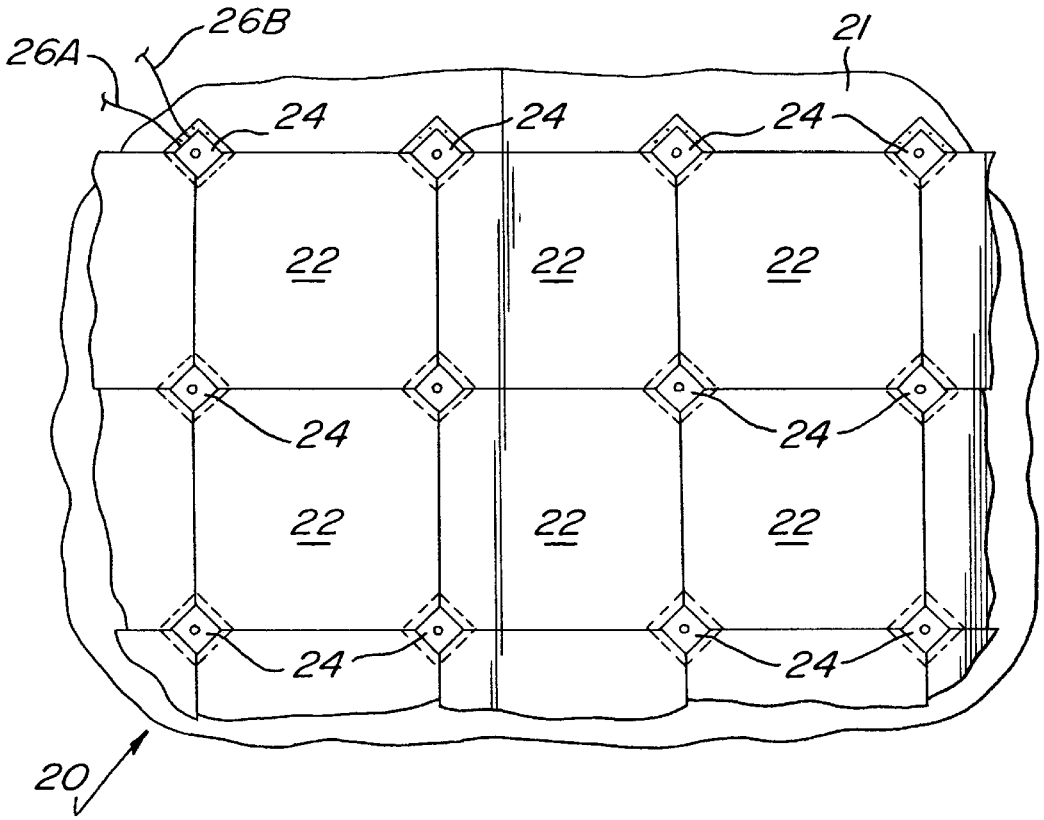
FIG. 1 is a top plan view of the reactive floor tiling system.

Referring now in greater detail to the various figures of the drawing wherein like reference characters refer to like parts, a reactive floor tiling system (hereinafter, "system") constructed in accordance with the present invention is shown generally at 20 in FIG. 1. The system 20 forms a tessellation, with large and small tiles, of a floor to be protected (e.g., a hospital floor, examination room floor, or any floor portion where a person may be prone to falling). The pattern shown in FIG. 1 is exemplary only.

In general, the system 20 comprises large, octogonal-shaped detonator tiles 22 and small, square-shaped detector tiles 24 that are secured to any conventional flooring foundation 21. As will be discussed in detail later, each detector tile 24 is surrounded by four immediately-adjacent detonator tiles 22. When a particular detector tile 24 detects a falling person, the detector tile 24 activates its four immediately-adjacent detonator tiles 22 which immediately inflate air bags (also discussed later) that are stowed in each detonator tile 22 to "catch" the falling person.

Figure 2:
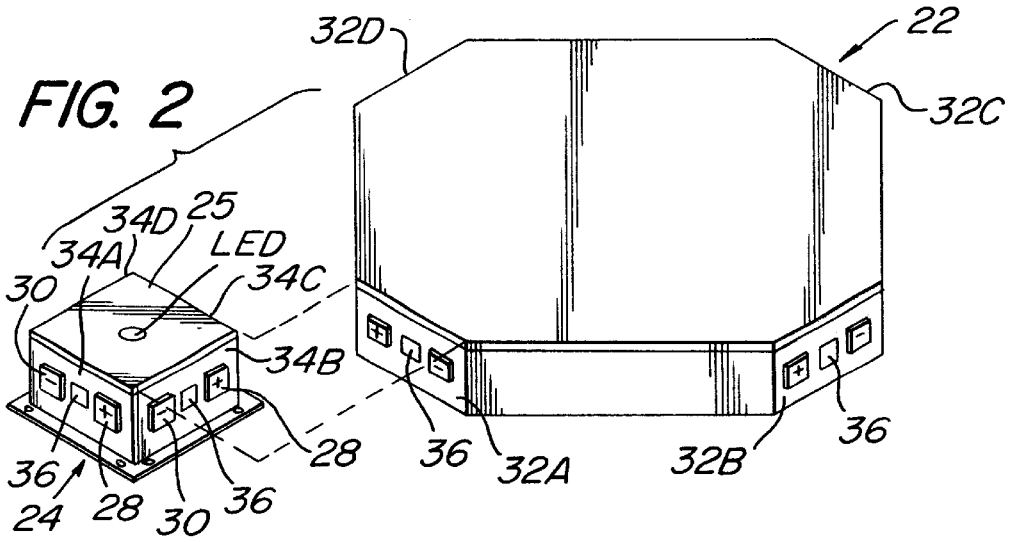
FIG. 2 is an isometric view of a detector tile and a detonator tile of the present invention.
Figure 3:
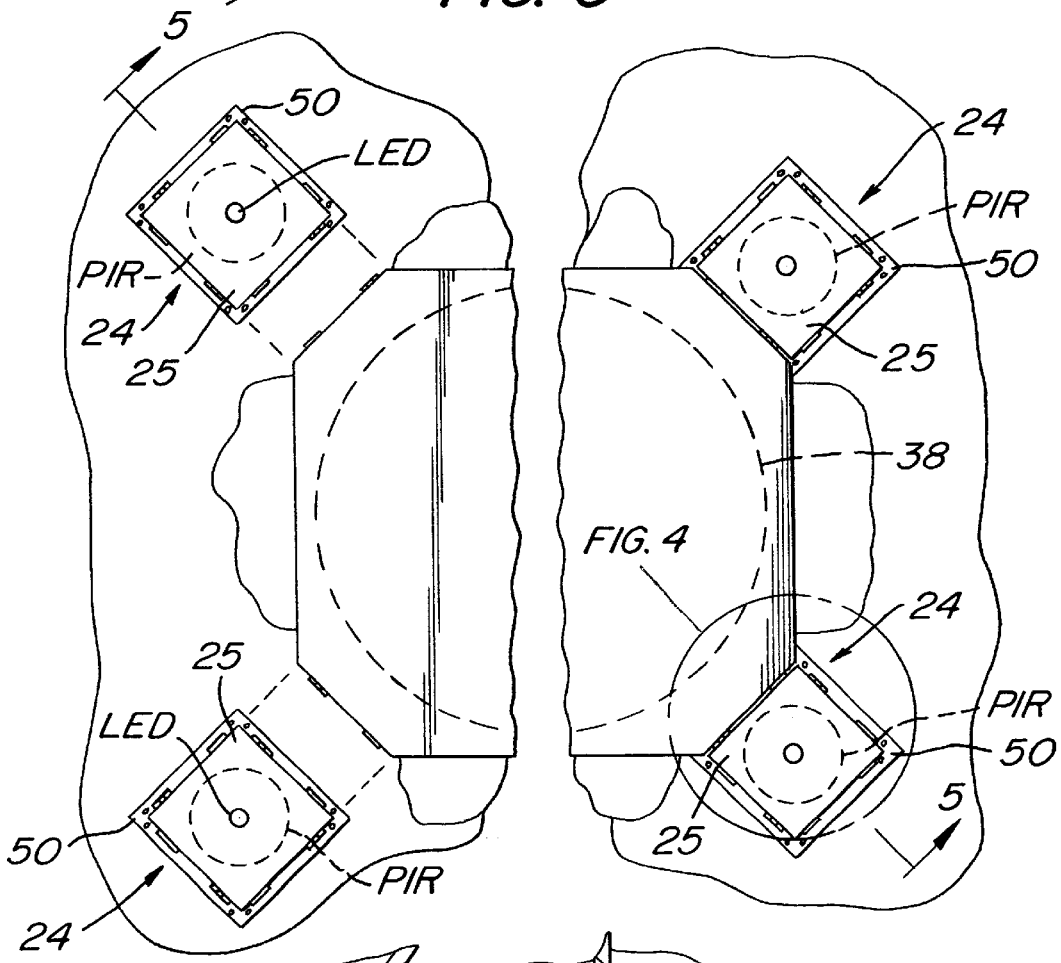
FIG. 3 is a top plan view of a detonator tile and four immediately-adjacent detector tiles, any one of which can activate the detonator tile.

Power to the system 20 can be from conventional wall outlet power (e.g., 50/60 Hz, 110 VAC). An AC/DC converter (not shown) is used to generate the input voltage, $V_{in}$ (FIG. 6), to the system 20 which is provided via two conductors 26A/26B (FIG. 1) to one of the detector tiles 24. As can be seen most clearly in FIG. 2, electrical power contacts 28/30 on both the detonator tiles 22 and the detector tiles 24 permit the "propagation" of power throughout the system 20 whenever adjacent detonator tiles 22 and detector tiles 24 are in physical contact. The detonator tiles 22 comprise the electrical power contacts 28/30 only on their corner faces 32A–32D whereas the detector tiles 24 comprise the electrical power contacts 28/30 on each their four sides 34A–34D. It should be understood that the electrical power.contacts 28/30 in each detonator tile 22 are internally wired together to support this "propagation" of electrical power. Similarly, the electrical power contacts 28/30 in each detector tile 24 are also internally wired (FIG. 4) to also support this "propagation" of electrical power.

Another electrical contact, namely a "trigger" contact 36 is located on the detonator tile corner faces 32A–32D and on the detector tile sides 34A–34D. The trigger contact 36 provides the means for energizing the air bag 38 (FIG. 5). In particular, when the detector tile 24 detects a falling person, the detector tile electronics (FIG. 6, to be discussed later) passes the air bag triggering signal through its trigger contact 36 and into the detonator tile trigger contact 36 which, in turn, is coupled to an air bag electrical contact 40 (FIG. 4) which inflates the air bag when energized.

As stated previously, when a particular detector tile 24 detects a falling person, the detector tile 24 activates its four immediately-adjacent detonator tiles 22 which immediately inflate air bags 38 that are located underneath each detonator tile 22 to "catch" the falling person. Thus, the trigger contacts 36 of each detector tile 24 are internally wired together so that upon detection of the falling person, the trigger contact 36 on all four sides 34A –34D of the detector tile 22 are asserted to activate the four immediately-adjacent detonator tiles 22. Because each detonator tile 22 comprises a single air bag contact 40, each trigger contact 36 on the corner faces 32A–32D are also wired together at a junction point 42. One consequence of this internal wiring is that a single triggering signal from one detector tile 22 could "propagate" throughout the entire system 20 causing all of the detonator tiles 22 to fire. To prevent this from occurring, a diode D1 (FIG. 4) is positioned between each trigger contact 36 and the junction point 42 that feeds the air bag contact 40.

As shown most clearly in FIG. 5, each detonator tile 22 comprises a hollow housing 44 in which the compressed air bag 38 is stowed. The air bag 38 comprises a sodium azide-loaded, inflatable plastic bag that expands, upon detonation, to approximately 18 cm (e.g., 4–5 liters of $N_2$). Detonation of the air bag 38 occurs, as is known in the art, when the sodium azide is electrically-charged via the trigger contact 36 of the detonator tile and to the air bag contact 40. The air bag 39 is constructed exactly the same as automobile air bags, except because of the lower velocities the air bag 38 is smaller, uses less explosive, and can expand more slowly. In addition, the air bag 38 is not designed to deflate; instead, after detonation, the entire detonator tile 22 is removed and replaced with a new detonator tile 22. A cap 46 is fixedly secured to the top of the air bag 38. The cap 46 is shaped to rest on top of the housing sidewalls of the detonator tile 22.

When installing the detonator tile 22 into the system 20, the tile 20 is dropped into place in between surrounding detector tiles 24, thereby making a snug fit such that the electrical power contacts 28/30, as well as the trigger contacts 36, form a good electrical connection with the immediately adjacent detector electrical power 28/30 and trigger 36 contacts. Cut-outs 48 in the bottom surface of the housing 44 provide for alignment with securement flanges 50 of the detector tiles 24, discussed next.

The detector tiles 24 are removably secured to the flooring foundation 21 via fasteners (e.g., screws 52) that secure the securement flanges 50 against the foundation 21. Once the four immediately-adjacent detector tiles 24 are so installed, the detonator tile 22 can be snugly fit between them with the cut-outs 48 fitting over the securement flanges 50 (FIG. 5) and the electrical power contacts 28/30 and the trigger contacts 36 making good electrical contact.

Figure 4:
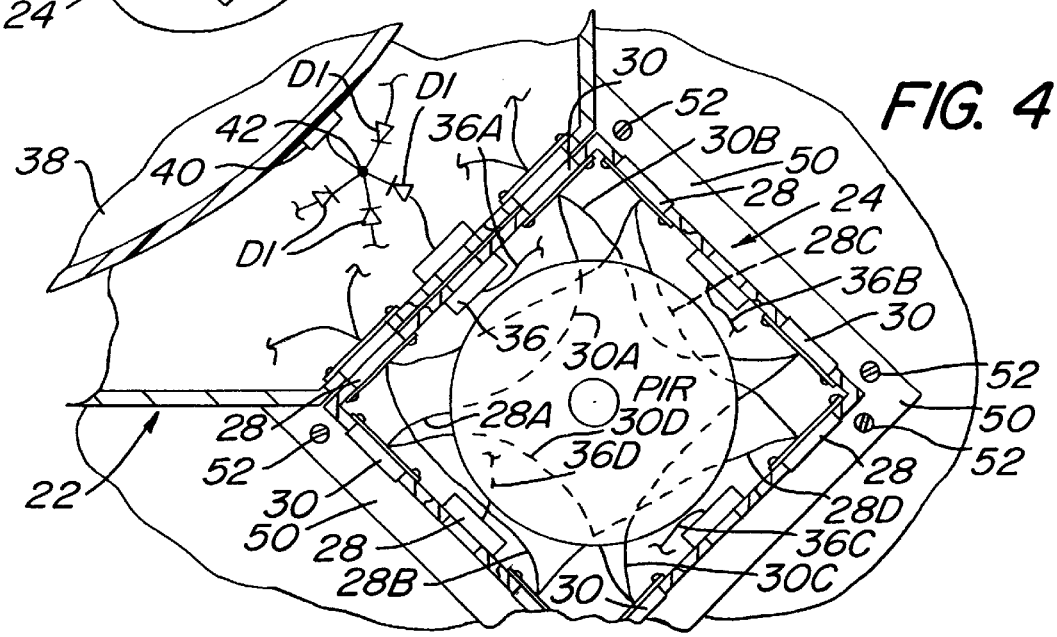
FIG. 4 is an enlarged view of the detector tile of FIG. 3 showing the internals of the detector tile.
Figure 5:
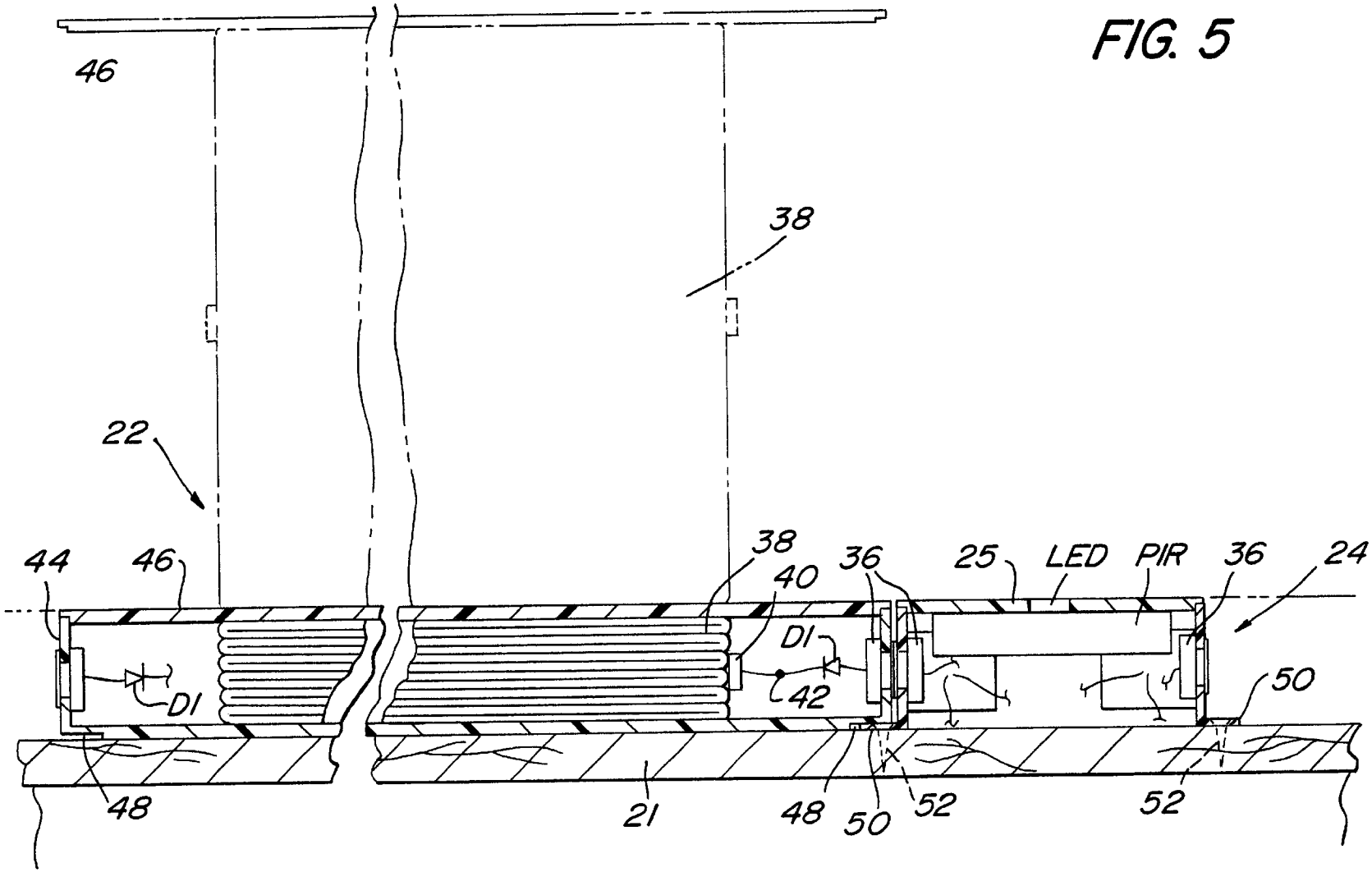
FIG. 5 is cross-sectional view of the detonator tile and adjacent detector tile taken along line 5—5 of FIG. 3 and includes a view (in phantom) of a detonated air bag.

FIG. 4 depicts the internal wiring of the detector tile 24. In particular, all four of the positive power contacts 28 are electrically connected through jumper wires 28A–28D. The negative power contacts 30 are electrically connected through jumper wires 30A–30D. The trigger contacts 36 of the detector tile 24 are electrically connected to each other through jumper wires 36A–36D.

The detonator files 22 (in their compressed air bag 38 state) and the detector tiles 24 are approximately 12 mm in thickness.

Figure 6:
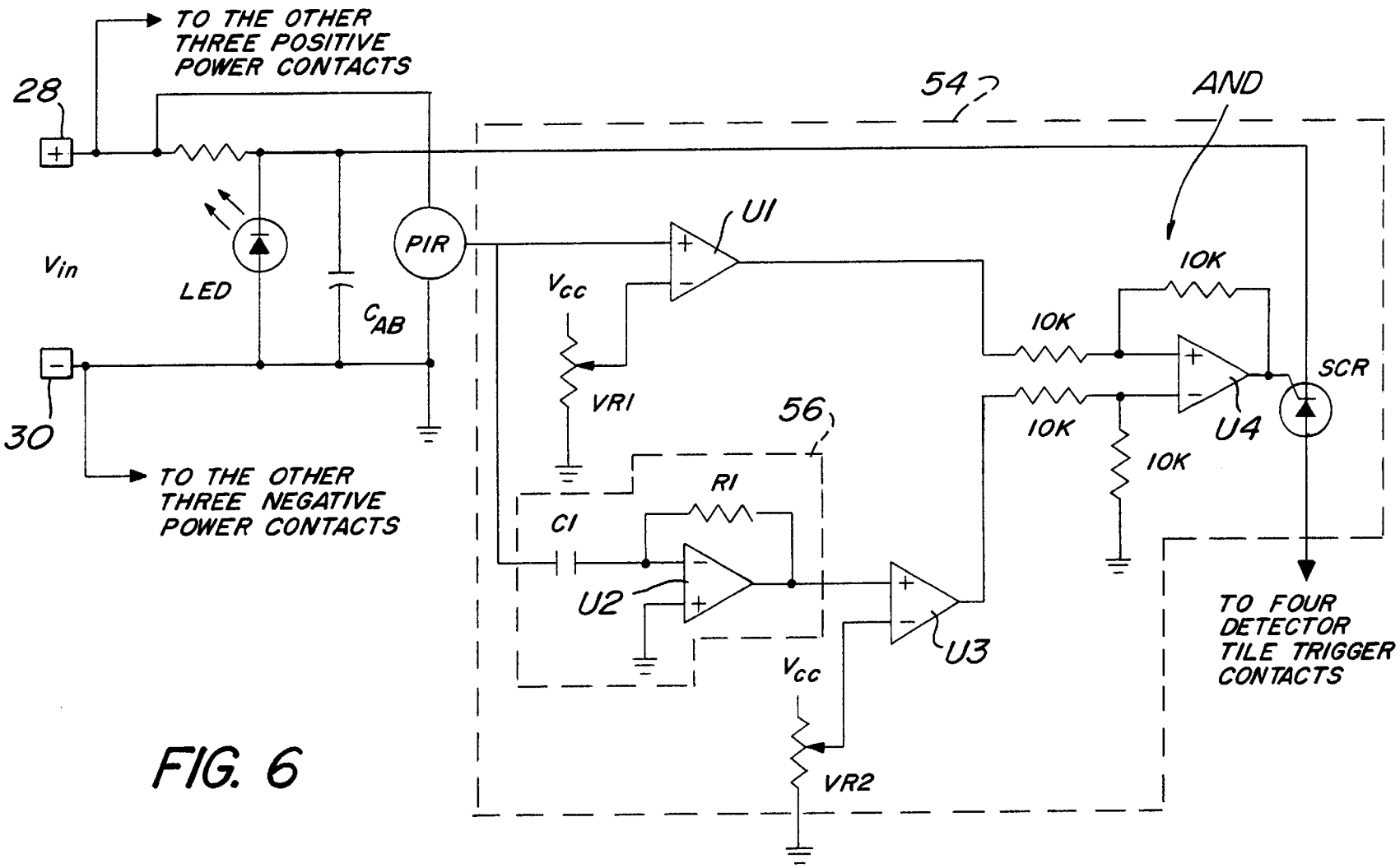
FIG. 6 is an electrical schematic of the electronics of the detector tile.

Operation of the detector tile 24 electronics is discussed next, as depicted in FIG. 6.

The detector tile 24 basically comprises a passive infrared motion detector (PIR), a capacitor $C_{AB}$, a charged-capacitor indicator (LED), and threshold circuit 54 which includes a silicon-controlled rectifier (SCR). In operation, the capacitor $C_{AB}$ charges continuously, compensating for any leakage. When the capacitor $C_{AB}$ is fully charged, the LED is illuminated. This allows maintenance personnel to visually scan the room for broken or defective detector tiles 24. When the PIR detects motion of a human at a sufficient velocity, as determined by the threshold circuit 54 (to be discussed later), the threshold circuit 54 triggers the SCR, which discharges the capacitor $C_{AB}$ into the four immediately-adjacent detonator tiles through the trigger contacts 36 and the air bag contact 40. These air bags 38 expand to their full height, cushioning the fall and preventing injury.

The PIR is a standard, commercially available monolithic component. One exemplary type of PIR is a pyroelectric infrared sensor manufactured by NICERA (Nippon Ceramic Corporation of 372-4 kumoyama, Tottori-shi, Japan), such as the SSAC10-11 or SEA02-4 that have spectral responses in the 7–14 $\mu$m range. The human body radiates infrared radiation according to its temperature. It is also known in the art that the peak emission wavelength for a black body is given by $\lambda_m T=0.0029$, where $\lambda_m$ is the wavelength in meters, and T is the temperature in Kelvin. For a human body at, e.g., 37° C., this yields a peak emission at 9.35 $\mu$m, which directly falls within the spectral response of the PIR of 7–14 $\mu$m. As a result, the top surface 25 of the detector tile 24 comprises a material (e.g., epoxy or acrylic) that is transparent to the infrared range of 7–14 $\mu$m.

In particular, the human body emits infrared radiation, to a first approximation, according to the black-body equation:

$$I_\lambda = \frac{2\pi c^2 h}{\lambda^5} \frac{1}{e^{\frac{ch}{\lambda kt}} - 1}$$

where:

k=Boltzman's constant;

c=speed of light;

h=Planck's constant;

$\lambda$=wavelength of emitted radiation; and

I=intensity of the radiation.

Over the range of sensitivity of a typical infrared PIR detector (SSAC10-11, Nicera Corporation 372-4 kumoyama, Tottori-shi, Japan), 7–14 $\mu$m, a human body at 310 Kelvin, 1.2 $m^2$ surface area, emits:

$$P = \int_{7\,\mathrm{nm}}^{14\,\mathrm{nm}} \frac{2\pi c^2 h}{\lambda^5} \frac{1}{e^{\frac{ch}{\lambda kt}} - 1} d\lambda$$

This gives an output P on the order of a few watts in the range of interest. Considering the angle subtended by the PIR (area 1.75 $mm^2$), the received energy is given by:

$$E = P\frac{0.0175}{4\pi d^2}$$

where d=distance from PIR to body in centimeters.

The PIR sensors have the property of relatively linear output, in the case of the SSAC 10-11, 2400 voltstwatt. So, the output voltage of the PIR is given by:

$$V = \frac{3.34}{d^2}$$

Thus, a human body at 1 meter will, therefore, give a voltage on the order of 0.1 millivolts in this particular sensor.

The threshold circuit 54 operates based on this PIR sensor output. In particular, the output voltage of the PIR is checked against an absolute threshold detector comprising a comparator U1 and a velocity threshold detector that comprises a differentiator circuit 56 and another comparator U3. The outputs of these two thresholds are then fed to an AND gate (e.g., a differential op amp U4) whose output drives the SCR. Thus, if the output of both the absolute threshold detector and the velocity threshold detector are exceeded, the AND gate is asserted and triggers the SCR in order to fire the immediately-adjacent detonator tiles 22.

The absolute threshold detector comprises an operational amplifier (e.g., one operational amplifier available on a Fairchild USA LM-324 quad op-amp IC) configured as a comparator with the PIR output coupled to the positive terminal of the op amp U1 and the negative terminal of U1 coupled to an adjustable voltage reference VR1. VR1 is the PIR voltage output that corresponds to a human body detected at approximately 1 meter and, as discussed above, which is approximately 0.1 millivolts. If the PIR output equals or exceeds 0.1 mV, the comparator U1 goes hardover to $+V_{cc}$; otherwise, the output of the comparator U1 remains hardover at $-V_{cc}$. Therefore, the absolute threshold detector is used to distinguish between a large object (e.g., the torso or buttocks of a human) detected by the PIR and a small object (e.g., the foot of a human corresponding to someone walking over the detector tile) detected by the PIR.

Simultaneously, the threshold circuit 54 also checks to see how fast the emission detected by the PIR is changing, i.e., if the large object is "falling." In particular, the differentiator circuit 56 (e.g., with R1=500 kΩ and C1=0.1 $\mu$F wherein R1·C1=0.05 sec, and an operational amplifier U3 such as the quad op amp IC LM-324) takes the time derivative of the PIR output and is used to increase the sensitivity to high velocity. The circuit 56 then feeds the differentiator output to the comparator U3 which compares the differentiator output against an adjustable voltage reference VR2 which is a voltage value that corresponds to the gravitational acceleration constant, g(980 cm/$sec^2$), since a freely-falling object has a constantly increasing velocity close to g. If the differentiator output equals or exceeds VR2, the comparator U3 will go hardover to the opposite power supply rail, $V_{cc}$.

The output of comparator U1 and comparator U3 are fed into an AND gate which controls the activation of the SCR. Only when both outputs of comparators U1 and U3 are asserted (i.e., a human body is detected and it is falling) does the AND gate trigger the SCR. As shown in FIG. 6, one exemplary manner of implementing an AND gate is using a differential operational amplifier (U4, such as quad op amp IC LM-324) using 10 kΩ resistors. Thus, small objects falling may trigger the velocity threshold detector but will fail to trigger the absolute threshold detector, even if the small object is warm. Similarly, a human simply getting down to the floor to look for something will not trigger the detonator tile 22 because the velocity threshold detector does not detect sufficient velocity.

The cost of the detonator tiles 22 may be up to $50.00 each, thus costing about $5000.00 for a typical patient room in a hospital. However, over the life of the floor, this compares favorably to the cost of each extra hospital day ($1000.00) to care for a person injured by a fall. The savings are even greater when considering the prevention of a broken hip (~$15,000.00). In addition, patients at riskforfalls are often restrained (tied) into beds or chairs. The floor of the present invention allows patients more freedom and safety.

Without further elaboration, the foregoing will so fully illustrate my invention that others may, by applying current or future knowledge, readily adopt the same for use under various conditions of service.

I claim:

1. An apparatus for use as a floor to automatically prevent an individual from falling against said floor, said apparatus comprising:

a detonator device having an inflatable means stored therein, said detonator device having a top surface that acts as part of said floor when said inflatable means is in a stowed condition in said detonator device; and a detector device being electrical communication with said detonator device and being immediately adjacent said detonator device, said detector device having a top surface that acts as part of said floor, said detector device comprising a detector for detecting an individual falling towards said detector and activating said inflatable means to drive said top surface of said detonator device towards the falling individual.

2. The apparatus of claim 1 further comprising a plurality of said detector devices being in electrical communication with said detonator device and being immediately adjacent said detonator device wherein any one of said plurality of said detector devices activates said inflatable means.

3. The apparatus of claim 2 wherein each of said detector devices comprises first electrical power terminals and said detonator tile comprises second electrical power terminals in electrical communication with said first electrical power terminals for conveying electrical power from a power source to other detonator tiles and other detector tiles in said floor.

4. The apparatus of claim 1 wherein said detector device comprises an indicator located in said top surface for indicating that said detector device is operational.

5. The apparatus of claim 1 wherein said detector device comprises a four-sided enclosure and wherein said detector device is in electrical communication with four detonator devices.

6. The apparatus of claim 5 wherein said detonator device comprises an octagonal-shaped enclosure, said detonator device being in electrical communication with four detector devices.

7. The apparatus of claim 1 wherein said inflatable means comprises an air bag that uses sodium-azide for inflation.

* * * * *